US009050808B2

(12) United States Patent
Takahashi

(10) Patent No.: US 9,050,808 B2
(45) Date of Patent: Jun. 9, 2015

(54) CAP AND INKJET RECORDING DEVICE

(71) Applicant: KYOCERA DOCUMENT SOLUTIONS INC., Osaka (JP)

(72) Inventor: So Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/166,767

(22) Filed: Jan. 28, 2014

(65) Prior Publication Data

US 2014/0210904 A1 Jul. 31, 2014

(30) Foreign Application Priority Data

Jan. 29, 2013 (JP) ..... 2013-014593

(51) Int. Cl.
*B41J 2/165* (2006.01)

(52) U.S. Cl.
CPC ..... *B41J 2/16505* (2013.01); *B41J 2/16511* (2013.01); *B41J 2/16588* (2013.01); *B41J 2002/16591* (2013.01)

(58) Field of Classification Search
CPC .... B41J 2/155; B41J 2/16505; B41J 2/16508; B41J 2/16511; B41J 2/16526; B41J 2/16535; B41J 2/16547; B41J 2/16552; B41J 2/16585
USPC ..... 347/22, 29
See application file for complete search history.

(56) References Cited

U.S. PATENT DOCUMENTS

| | | | | |
|---|---|---|---|---|
| 5,216,449 | A | 6/1993 | English | |
| 5,517,220 | A | 5/1996 | English | |
| 2004/0113971 | A1* | 6/2004 | Nakajima | 347/29 |
| 2004/0246295 | A1* | 12/2004 | Aldrich et al. | 347/29 |
| 2004/0252157 | A1* | 12/2004 | Yamazaki et al. | 347/31 |
| 2005/0024422 | A1* | 2/2005 | Danzuka | 347/29 |
| 2005/0110827 | A1* | 5/2005 | Aldrich et al. | 347/29 |
| 2007/0070115 | A1* | 3/2007 | Shindo | 347/29 |
| 2009/0027444 | A1* | 1/2009 | Yoshida et al. | 347/29 |
| 2010/0045733 | A1* | 2/2010 | Mano | 347/29 |
| 2011/0018931 | A1* | 1/2011 | Ikeda | 347/29 |
| 2011/0199422 | A1* | 8/2011 | Shimazaki | 347/29 |
| 2014/0210903 | A1* | 7/2014 | Tanda | 347/29 |

FOREIGN PATENT DOCUMENTS

JP 5-201010 A 8/1993

* cited by examiner

*Primary Examiner* — Manish S Shah
*Assistant Examiner* — Roger W Pisha, II
(74) *Attorney, Agent, or Firm* — Studebaker & Brackett PC

(57) ABSTRACT

A cap includes a cap body and an atmosphere communication portion. The cap body comes into contact with and is pressed against a portion around an ink outlet of a nozzle head to form a main space between the cap body and the nozzle head. The atmosphere communication portion includes a ventilation hole, a sub-space, and a ventilation channel. The ventilation hole is open to the main space. The sub-space retains ink entering the ventilation hole. The ventilation channel allows the sub-space to be in communication with the atmosphere.

13 Claims, 6 Drawing Sheets

CAP AND INKJET RECORDING DEVICE

INCORPORATION BY REFERENCE

The present application claims priority under 35 U.S.C. §119 to Japanese Patent Application No. 2013-014593, filed Jan. 29, 2013. The contents of this application are incorporated herein by reference in their entirety.

BACKGROUND

The present disclosure relates to caps and inkjet recording devices.

Inkjet recording devices are widely used in printers, copiers, multifunction peripherals, etc., because of their small size, low cost, little noise during operation, etc. Inkjet recording devices form an image on a recording medium such as paper etc. by ejecting droplets of ink onto the recording medium through a number of nozzles provided in a nozzle head.

If ink is dried at the ink outlet of the nozzle tip, the concentration of the ink increases and therefore the ink may plug the ink outlet. Therefore, inkjet recording devices are equipped with a cap for capping the ink outlet.

In inkjet recording devices, a so-called meniscus which is the slightly concave surface of ink due to surface tension is formed at the ink outlet. The meniscus is broken by a very small pressure. If the meniscus is broken, the ejection of ink droplets unfortunately becomes unstable in inkjet recording devices, for example.

When the ink outlet is capped by the cap and therefore the space inside the cap is hermetically sealed, the pressure in the space is likely to cause the ink to overflow or break the meniscus. To address such a problem, a structure has been proposed which allows the space inside the cap to be in communication with the atmosphere.

SUMMARY

A cap according to a first embodiment of the present disclosure for capping an ink outlet of a nozzle head, includes a cap body and an atmosphere communication portion. The cap body comes into contact with and is pressed against a portion around the ink outlet of the nozzle head to form a main space between the cap body and the nozzle head. The atmosphere communication portion allows the main space to be in communication with the atmosphere. The atmosphere communication portion includes a ventilation hole, a sub-space, and a ventilation channel. The ventilation hole is open to the main space. The sub-space retains ink entering the ventilation hole. The ventilation channel allows the sub-space to be in communication with the atmosphere.

An inkjet recording device according to a second embodiment of the present disclosure includes a nozzle head having an ink outlet, and a cap configured to cap the ink outlet. The cap includes a cap body and an atmosphere communication portion. The cap body comes into contact with and is pressed against a portion around the ink outlet of the nozzle head to form a main space between the cap body and the nozzle head. The atmosphere communication portion allows the main space to be in communication with the atmosphere. The atmosphere communication portion includes a ventilation hole, a sub-space, and a ventilation channel. The ventilation hole is open to the main space. The sub-space retains ink entering the ventilation hole. The ventilation channel allows the sub-space to be in communication with the atmosphere.

DETAILED DESCRIPTION

Figure 1:
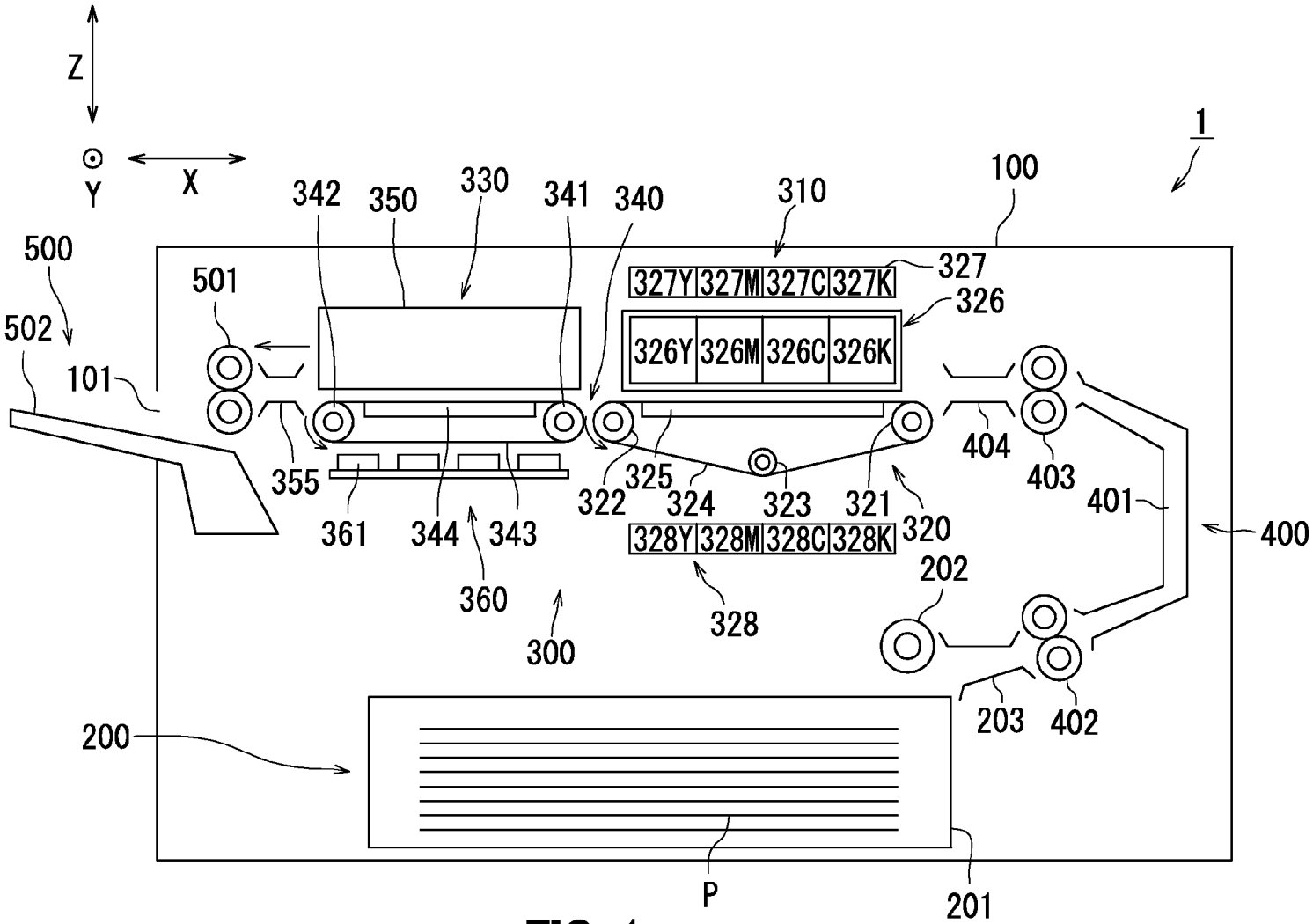
FIG. 1 is a diagram schematically showing a general configuration of an inkjet recording device according to an embodiment of the present disclosure.

Embodiments of the present disclosure will be described with reference to the accompanying drawings. FIG. 1 is a diagram schematically showing a general configuration of an inkjet recording device 1 according to an embodiment.

The inkjet recording device 1 includes a device housing 100, a paper feed unit 200 provided in a lower internal portion of the device housing 100, an image forming unit 300 provided above the paper feed unit 200, a paper transport unit 400 provided on one side of the image forming unit 300, and a paper exit unit 500 provided on the opposite side of the image forming unit 300 from the paper transport unit 400.

The paper feed unit 200 includes a feed cassette 201 which is removably inserted into the device housing 100, a feed roller 202, and a guide plate 203. The feed roller 202 is located above an end of the feed cassette 201. The guide plate 203 is located between the feed roller 202 and the paper transport unit 400.

A stack of sheets of paper P is stored in the feed cassette 201. The feed roller 202 picks up the paper P from the feed cassette 201, one sheet at a time. The guide plate 203 guides the paper P picked up by the feed roller 202 to the paper transport unit 400.

The paper transport unit 400 includes a substantially C-shaped paper transport path 401, a pair of transfer rollers 402 provided at a start point of the paper transport path 401, a pair of registration rollers 403 provided at an end point of the paper transport path 401, and a guide plate 404 provided between the registration roller pair 403 and the image forming unit 300.

The transfer roller pair 402 nips the paper P fed by the paper feed unit 200 and transports the paper to the paper transport path 401. The registration roller pair 403 corrects a skew of the paper P fed from the paper transport path 401. Thereafter, the registration roller pair 403 temporarily stops the paper P in order to synchronize the transportation of the paper P with the timing of printing, and then transports the paper P to the guide plate 404 in synchronization with the timing of printing. The guide plate 404 guides the paper P fed by the registration roller pair 403 to the image forming unit 300.

The image forming unit 300 includes a recording unit 310, a drying unit 330, a cap unit 360, and a drive mechanism (not shown).

The recording unit 310 includes a transport unit 320, a recording head 326 provided above the transport unit 320, a pump unit 327 provided above the recording head 326, and a tank unit 328 provided below the transport unit 320.

The transport unit 320 includes a support roller 321, a drive roller 322, a tension roller 323, an endless transport belt 324, and a suction unit 325. The transport belt 324 is supported by the support roller 321, the drive roller 322, and the tension roller 323, spanning a space between each of these rollers, with tension being exerted on the transfer belt 324. A number of suction pores (not shown) are provided in the transport belt 324.

The drive roller 322 is located at a distance from the support roller 321 in a direction in which paper is transported. The drive roller 322 is driven and rotated by a motor (not shown) to rotate the transport belt 324 counterclockwise. The tension roller 323 is located below a space between the support roller 321 and the drive roller 322, with tension being exerted on the transport belt 324 so that the transport belt 324 does not sag.

The recording head 326 includes four nozzle heads 326K, 326C, 326M, and 326Y which are arranged side by side from upstream to downstream in the paper transport direction.

The pump unit 327 includes four ink supply pumps 327K, 327C, 327M, and 327Y which are arranged side by side from upstream to downstream in the paper transport direction.

The tank unit 328 includes four ink tanks 328K, 328C, 328M, and 328Y which are arranged side by side from upstream to downstream in the paper transport direction.

The nozzle heads 326K, 326C, 326M, and 326Y each include a number of nozzles aligned in a transverse direction (direction Y) of the transport belt 324. The recording head 326 is called a line type recording head. For example, the line type recording head 326 is fixed to the device housing 100.

The nozzles of the nozzle head 326K are all in communication with a pressure chamber (not shown) formed in the nozzle head 326K. The pressure chamber is in communication with an ink liquid chamber (not shown) formed in the nozzle head 326K. The ink liquid chamber is connected to and in communication with the ink supply pump 327K through a tube (not shown). The ink supply pump 327K is connected to and in communication with the ink tank 328K through a tube (not shown).

The nozzles of the nozzle head 326C are all in communication with a pressure chamber (not shown) formed in the nozzle head 326C. The pressure chamber is in communication with an ink liquid chamber (not shown) formed in the nozzle head 326C. The ink liquid chamber is connected to and in communication with the ink supply pump 327C through a tube (not shown). The ink supply pump 327C is connected to and in communication with the ink tank 328C through a tube (not shown).

The nozzles of the nozzle head 326M are all in communication with a pressure chamber (not shown) formed in the nozzle head 326M. The pressure chamber is in communication with an ink liquid chamber (not shown) formed in the nozzle head 326M. The ink liquid chamber is connected to and in communication with the ink supply pump 327M through a tube (not shown). The ink supply pump 327M is connected to and in communication with the ink tank 328M through a tube (not shown).

The nozzles of the nozzle head 326Y are all in communication with a pressure chamber (not shown) formed in the nozzle head 326Y. The pressure chamber is in communication with an ink liquid chamber (not shown) formed in the nozzle head 326Y. The ink liquid chamber is connected to and in communication with the ink supply pump 327Y through a tube (not shown). The ink supply pump 327Y is connected to and in communication with the ink tank 328Y through a tube (not shown).

The suction unit 325 is provided on one side of the transport belt 324, facing the recording head 326 with the transport belt 324 being interposed therebetween. The suction unit 325 includes in its interior a suction section (not shown), such as a fan, a vacuum pump, etc. When the suction section is actuated, a negative pressure occurs in the suction unit 325. The negative pressure acts on the paper P placed on the opposite side of the transport belt 324 from the suction unit 325, via the suction pores of the transport belt 324, whereby the paper P is sucked on the transport belt 324.

The drying unit 330 includes a transport unit 340, a drier 350 provided above the transport unit 340, and a guide plate 355.

The transport unit 340 includes a support roller 341, a drive roller 342, an endless transport belt 343, and a suction unit 344. The transport belt 343 is supported by the support roller 341 and the drive roller 342, spanning a space between the support roller 341 and the drive roller 342, with tension being exerted on the transport belt 343. The transport belt 343 has a number of suction pores (not shown).

The drive roller 342 is located at a distance from the support roller 341 in the paper transport direction. The drive roller 342 is driven and rotated by a motor (not shown) to rotate the transport belt 343 counterclockwise.

The suction unit 344 is provided on one side of the transport belt 343, facing the drier 350 with the transport belt 343 being interposed therebetween. The suction unit 344 includes in its interior a suction section (not shown), such as a fan, a vacuum pump, etc. When the suction section is actuated, a negative pressure occurs in the suction unit 344. The negative pressure acts on the paper P placed on the opposite side of the transport belt 343 from the suction unit 344, via the suction pores of the transport belt 343, whereby the paper P is sucked on the transport belt 343.

The drier 350 sends hot air to the paper P to dry ink droplets which have been ejected from the recording head 326 onto the paper P.

The guide plate 355 guides the paper P fed by the transport unit 340 to the paper exit unit 500.

The cap unit 360 includes a plurality of caps 361, one for each of the nozzle head 326K, 326C, 326M, and 326Y. The cap unit 360 is supported by a support bracket (not shown). The support bracket is slidably guided in a direction X along a guide rail (not shown). The caps 361 will be described in detail below. The support bracket supporting the cap unit 360 is slid by a drive mechanism (not shown) along the guide rail (not shown), whereby the cap unit 360 is moved in the direction X.

The paper exit unit 500 includes a pair of exit rollers 501 and an exit tray 502. The exit tray 502 is fixed to the device housing 100, protruding outward from an exit opening 101 formed in the device housing 100.

The paper P which has passed through the drier 350 is transported by the exit roller pair 501 toward the exit opening 101 and then guided to the exit tray 502 to exit the device housing 100 through the exit opening 101.

FIGS. 2A-2E are diagrams schematically showing operations of the transport unit 320 and the cap unit 360 of the inkjet recording device 1 of FIG. 1.

The inkjet recording device 1 further includes a lift mechanism 381. The lift mechanism 381 moves the transport unit 320 of the recording unit 310 up and down. The lift mechanism 381 includes a guide member (not shown), a wire 382, a roller 384, a motor 386, and a clutch 388.

The guide member extends vertically to guide and allow the transport unit 320 to move up and down in a direction Z.

One end of the wire 382 is attached to the transport unit 320 while the other end thereof is attached to the roller 384. The transport unit 320 hangs on and supports the wire 382.

The roller 384 is allowed to rotate about a rotating shaft (not shown) extending in the direction X. When the roller 384 is rotated in one direction, the wire 382 is wound around the roller 384. When the roller 384 is rotated in the opposite direction, the wire 382 is unwound from the roller 384.

The drive shaft (not shown) of the motor 386 is linked to the rotating shaft of the roller 384 via the clutch 388. The motor 386 rotates the roller 384 in both of the directions.

The clutch 388 connects and disconnects the drive shaft of the motor 386 to and from the rotating shaft of the roller 384.

Next, operations of the transport unit 320 and the cap unit 360 will be described with reference to FIGS. 2A-2E.

Figure 2A:
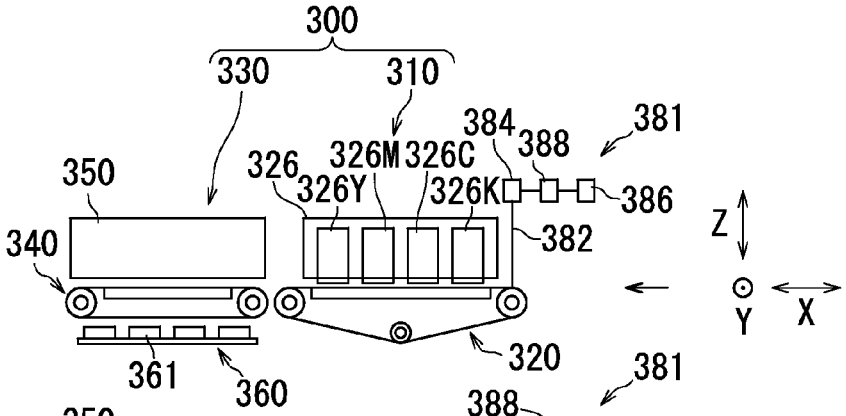
FIGS. 2A-2E are diagrams schematically showing operations of a transport unit and a cap unit of the inkjet recording device of FIG. 1.

FIG. 2A shows the image forming unit 300 which is ready to form an image on paper. The nozzle heads 326K, 326C, 326M, and 326Y of the recording head 326 eject ink onto paper. The ink on the paper is dried by the drier 350. As a result, an image is formed on the paper.

Figure 2B:
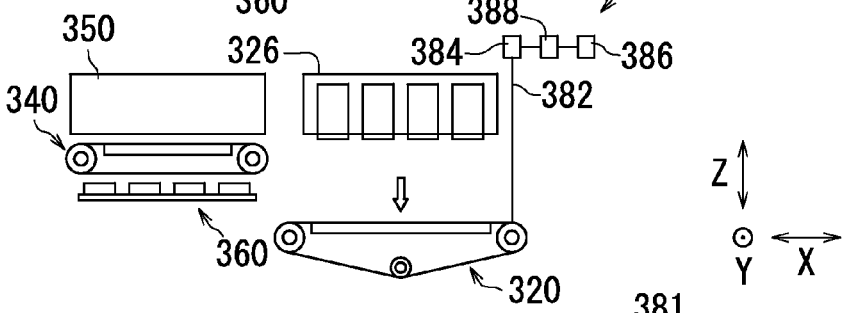

The ink outlets of the recording head 326 are capped as follows. Initially, as shown in FIG. 2B, the motor 386 of the lift mechanism 381 is driven so that the wire 382 is unwound from the roller 384, whereby the transport unit 320 is lowered to a predetermined position.

Figure 2C:
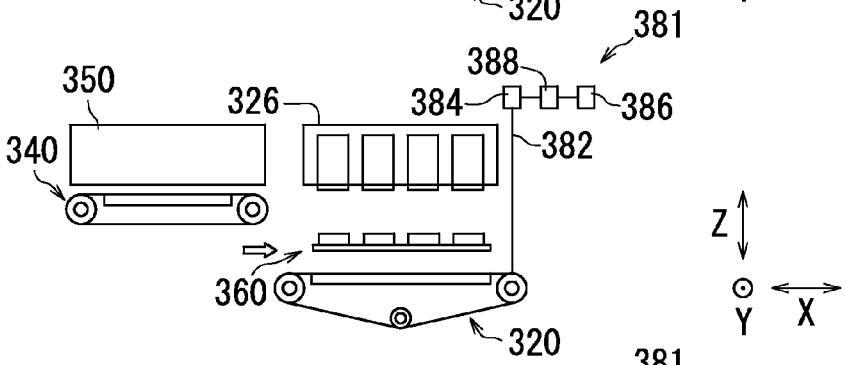

Next, as shown in FIG. 2C, the drive mechanism (not shown) horizontally moves the cap unit 360 to a position where the cap unit 360 is located directly below the recording head 326.

Figure 2D:
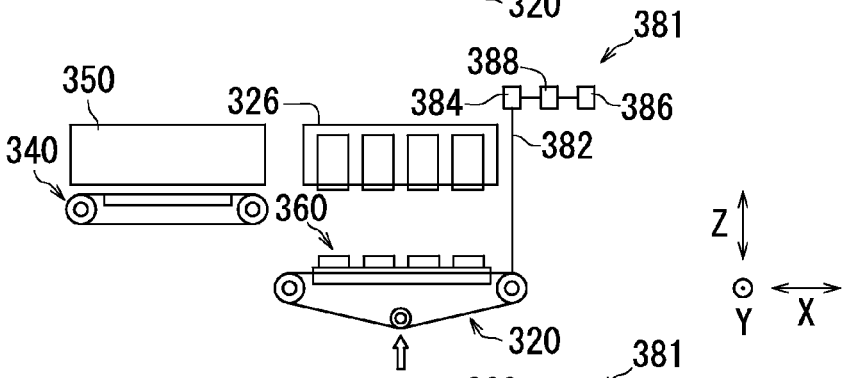

Next, as shown in FIG. 2D, the motor 386 of the lift mechanism 381 is driven so that the wire 382 is wound by the roller 384, whereby the transport unit 320 is lifted to come into contact with the cap unit 360.

Figure 2E:
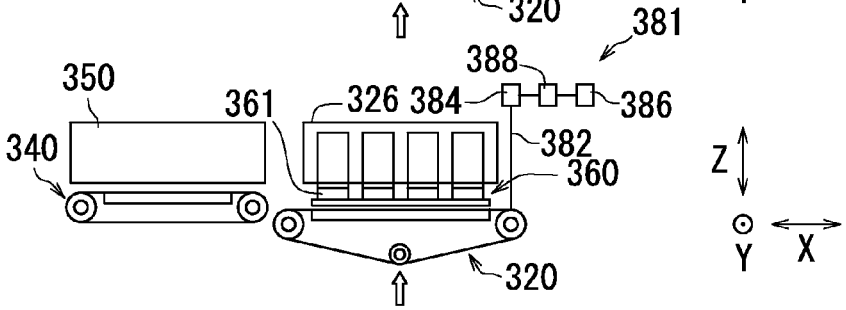

Next, as shown in FIG. 2E, the motor 386 of the lift mechanism 381 is driven so that the wire 382 is wound by the roller 384, whereby the transport unit 320 and the cap unit 360 are lifted. Therefore, the four caps 361 of the cap unit 360 come into contact with the nozzle head 326K, 326C, 326M, and 326Y of the recording head 326. As a result, the ink outlets of the nozzle head 326K, 326C, 326M, and 326Y are capped.

Figure 3:
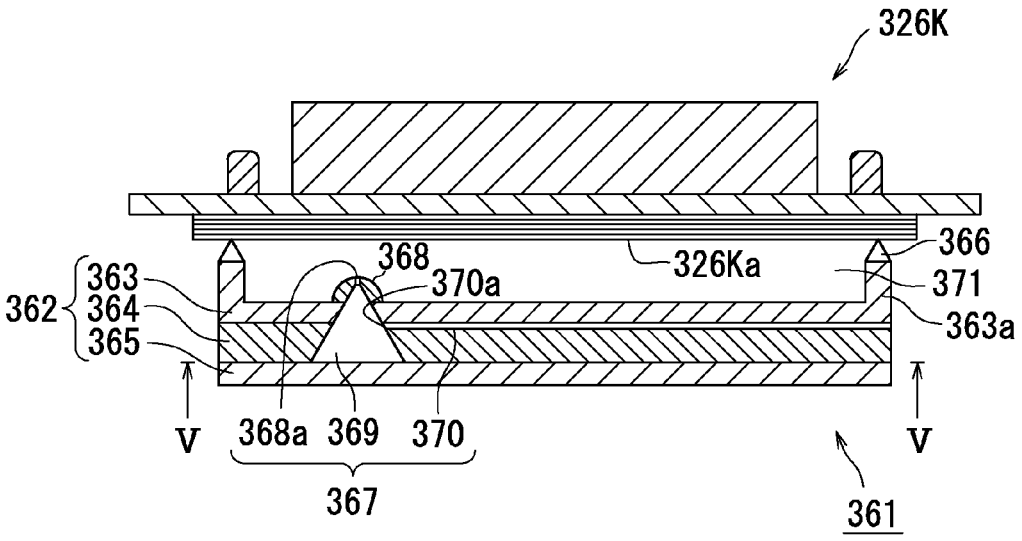
FIG. 3 is a cross-sectional view showing a cap according to a first embodiment which is attached to a nozzle head shown in FIG. 1.
Figure 4:
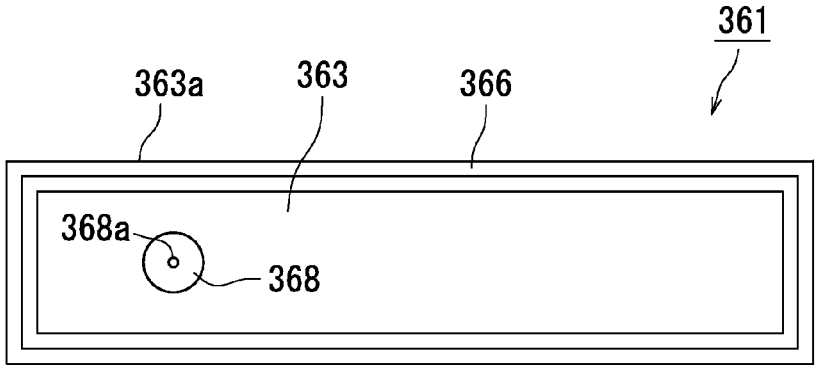
FIG. 4 is a plan view of the cap of the first embodiment.
Figure 5:
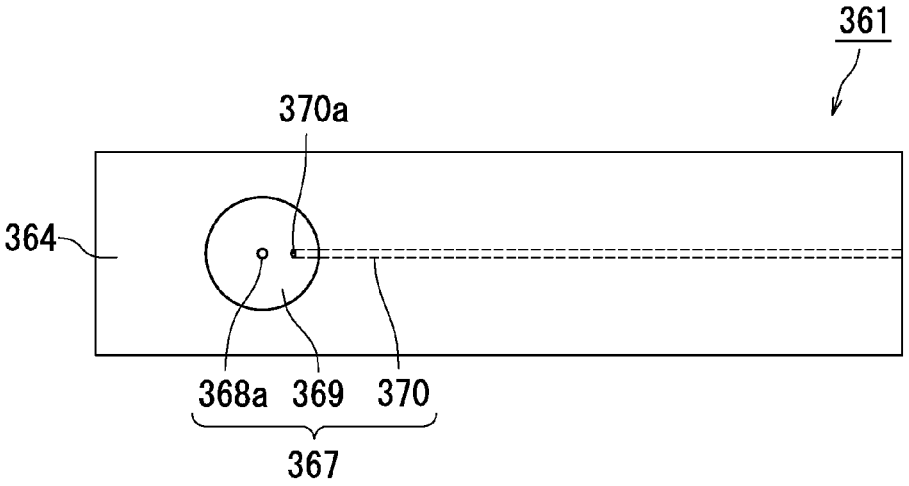
FIG. 5 is a cross-sectional view taken along line V-V of FIG. 3.

FIG. 3 is a cross-sectional view showing the cap 361 according to a first embodiment which is attached to the nozzle head 326K. FIG. 4 is a plan view of the cap 361 of the first embodiment. FIG. 5 is a cross-sectional view taken along line V-V of FIG. 3.

As shown in FIG. 3, the cap 361 is removably attached to a lower surface of the nozzle head 326K. The cap 361 is also attached to each of the nozzle heads 326C, 326M, and 326Y.

The cap 361 includes a cap body 362 and an atmosphere communication portion 367. The cap body 362 has a top wall 363, a middle wall 364, and a bottom wall 365.

The top wall 363 is formed of butyl rubber, EPDM, etc. A rectangular peripheral wall 363*a* protruding upward is provided on the top wall 363. A pressure contact portion 366 having a triangular cross-sectional shape is provided on top of the peripheral wall 363*a* (see FIG. 4).

The pressure contact portion 366 is formed of an elastic material having good sealing ability, such as butyl rubber, EPDM, etc. The pressure contact portion 366 comes into contact with and is pressed against a portion around the ink outlet (not shown) of the nozzle head 326K to form a main space 371 between itself and the nozzle head 326K. The ink outlet is provided in a lower surface 326Ka of the nozzle head 326K. The pressure contact portion 366 and the peripheral wall 363*a* may be integrally formed.

The middle wall 364 is formed of butyl rubber, EPDM, etc. The bottom wall 365 is formed of a material having a suitable stiffness (SUS etc.).

An air purging portion 368 is formed of butyl rubber, EPDM, etc. The air purging portion 368 is fixed to an upper surface of the top wall 363 of the cap body 362. The air purging portion 368 has a ventilation hole 368*a* which is open to the main space 371. The air purging portion 368 and the top wall 363 may be integrally formed.

The ventilation hole 368*a* has a small diameter (about 1 mm) so that it is difficult for ink to enter the ventilation hole 368*a*. The ventilation hole 368*a* is located above a bottom surface of the main space 371, and therefore, it is difficult for ink which has dropped onto the bottom surface of the main space 371 to flow into the ventilation hole 368*a*.

The atmosphere communication portion 367 includes the ventilation hole 368*a*, a sub-space 369, and a ventilation channel 370.

The sub-space 369 is formed in the shape of a circular cone. The sub-space 369 penetrates through the middle wall 364 and the top wall 363. An upper end portion of the sub-space 369 reaches the inside of the air purging portion 368 and therefore is in communication with the ventilation hole 368*a*. A bottom surface of the sub-space 369 is sealed by the bottom wall 365.

The ventilation channel 370 extends along an upper surface of the middle wall 364. One end of the ventilation channel 370 has an opening in an inner wall of the sub-space 369. The opening forms an entrance 370*a*. The other end of the ventilation channel 370 has an opening in a side surface of the middle wall 364. The ventilation channel 370 has a diameter of about 1 mm and a length of about 100 mm, for example. Note that the sub-space 369 has a diameter which does not allow ink entering the ventilation channel 370 to maintain a meniscus.

Figure 6A:
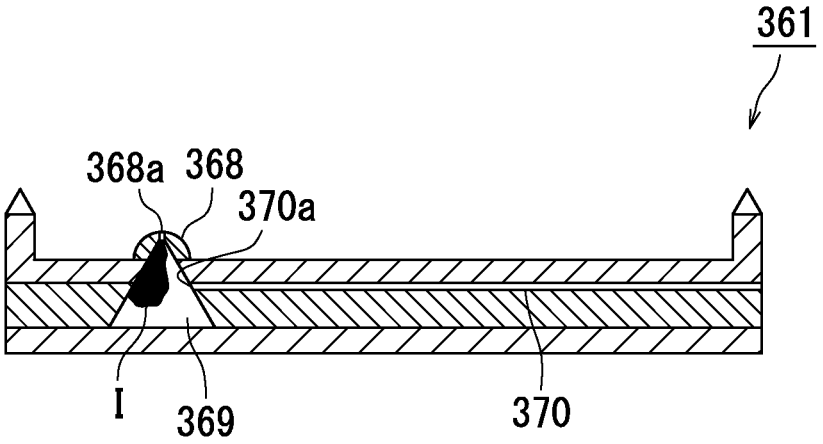
FIGS. 6A and 6B are diagrams for describing an action of the cap of the first embodiment.
Figure 6B:
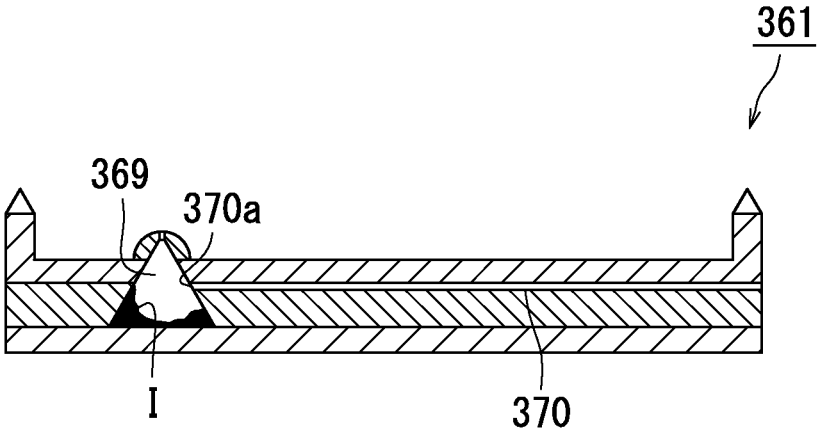

FIGS. 6A and 6B are diagrams for describing an action of the cap of the first embodiment. FIG. 6A is a diagram showing the sub-space 369 into which ink has flowed. FIG. 6B is a diagram showing the sub-space 369 in which ink has been accumulated in a bottom portion thereof.

When ink dropping from the ink outlets of the nozzle heads 326K, 326C, 326M, and 326Y enters the ventilation hole 368*a*, the ink I flows into the sub-space 369 as shown in FIG. 6A. Thereafter, the ink I moves gravitationally downward due to its weight, and is then accumulated in the bottom portion of the sub-space 369.

The cap 361 can be used without replacement until the ink I reaches the level of the entrance 370*a* of the ventilation channel 370. Because the sub-space 369 is in the shape of a circular cone which becomes gradually wider toward the bottom portion, a large amount of the ink I can be retained. Therefore, the cap 361 can be used for a longer period of time without replacement.

The ink I is not drained out of the cap 361. Therefore, a structure for processing the drained ink I is not needed, resulting in a reduction in manufacturing cost. It is noted that although the cap 361 is replaced with a brand-new one after a predetermined period of time has passed, the cap 361 can be used for a longer period of time, resulting in a reduction in running cost.

Figure 7:
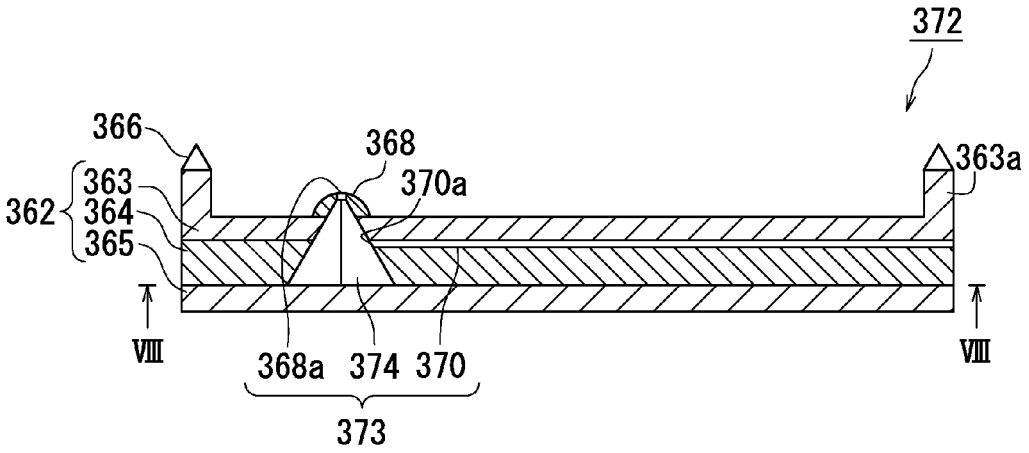
FIG. 7 is a cross-sectional view of a cap according to a second embodiment.
Figure 8:
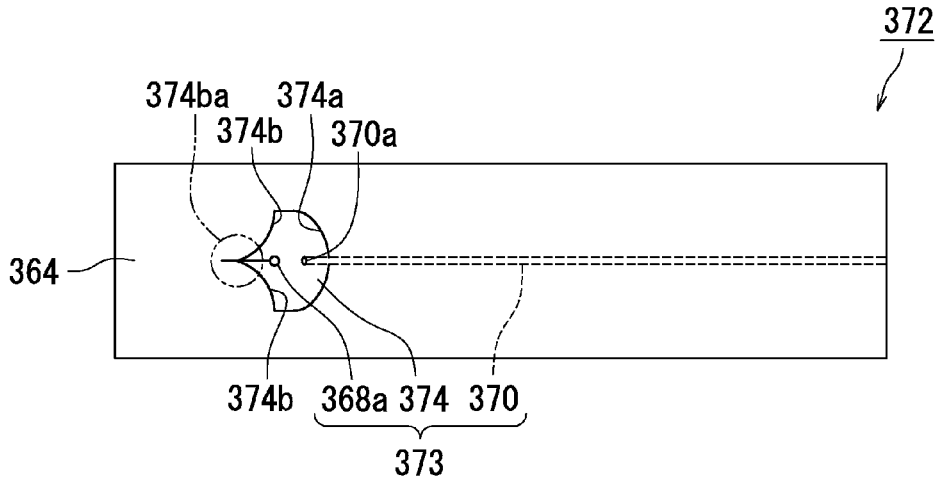
FIG. 8 is a cross-sectional view taken along line VIII-VIII of FIG. 7.

Next, a second embodiment of the present disclosure will be described. FIG. 7 is a cross-sectional view of a cap according to the second embodiment. FIG. 8 is a cross-sectional view taken along line VIII-VIII of FIG. 7. Note that, in the second embodiment, parts corresponding to those of the first embodiment are indicated by the same reference characters and will not be redundantly described.

The cap 372 according to this embodiment includes a sub-space 374 which has a cross-section having the shape of a gingko leaf and becomes continuously wider downward. The ventilation hole 368*a*, the sub-space 374, and the ventilation channel 370 form an atmosphere communication portion 373. An inner wall surface of the sub-space 374 has a first inner wall surface 374*a* having the shape of a semi-circular conical surface which curves outward, and a pair of second inner wall surfaces 374*b*. The second inner wall surfaces 374*b* each have the shape of a ¼ circular conical surface which curves inward.

The pair of second inner wall surfaces 374*b* become closer to each other in a direction away from the entrance 370*a* of the ventilation channel 370 which is an opening formed in the first inner wall surface 374*a*, to form an acute angle portion 374*ba* which functions as an ink guide portion. Ink which has flowed into the sub-space 374 is likely to enter the acute angle portion 374*ba* due to the capillary action, i.e., ink is guided to an opposite region of the sub-space 374 from the entrance 370*a*. Therefore, it is more difficult for ink to flow into the entrance 370*a*, and therefore, the ventilation channel 370 can be less likely to be clogged with ink.

Figure 9:
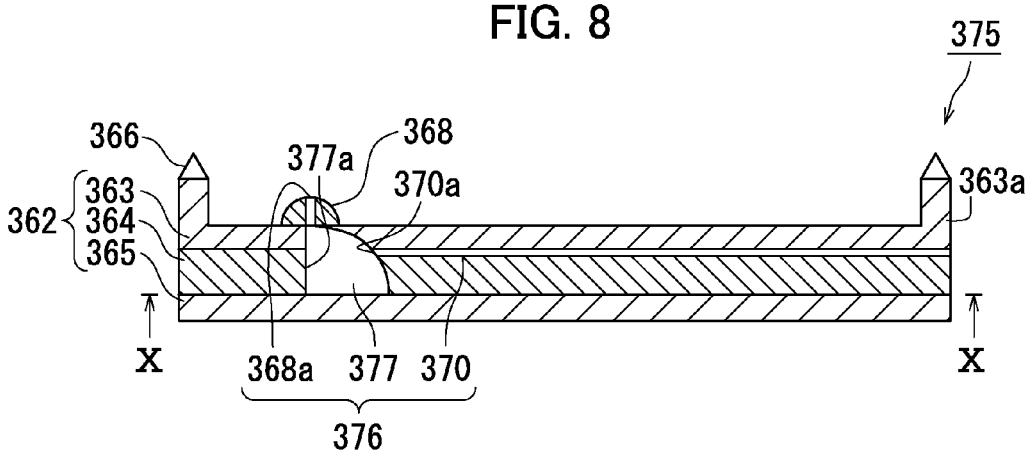
FIG. 9 is a cross-sectional view of a cap according to a third embodiment.
Figure 10:
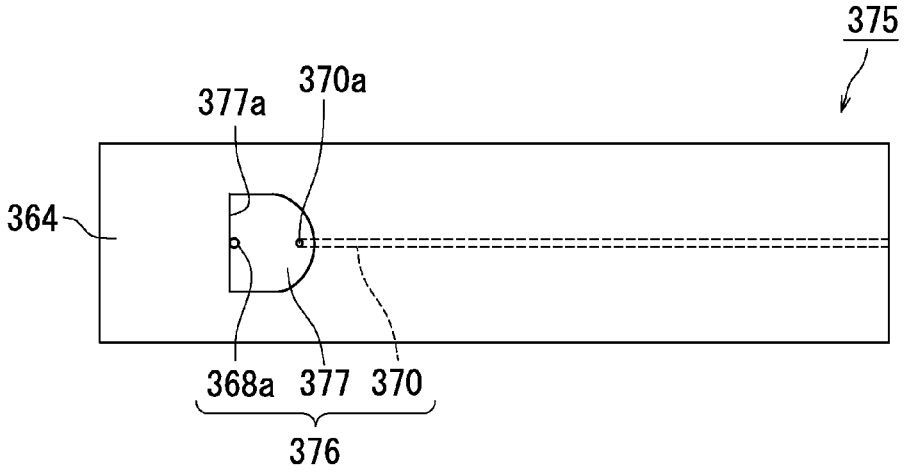
FIG. 10 is a cross-sectional view taken along line X-X of FIG. 9.

Next, a third embodiment of the present disclosure will be described. FIG. 9 is a cross-sectional view of a cap 375 according to the third embodiment. FIG. 10 is a cross-sectional view taken along line X-X of FIG. 9. Note that, in the third embodiment, parts corresponding to those of the first embodiment are indicated by the same reference characters and will not be redundantly described.

The cap 375 of this embodiment includes a sub-space 377 which has a cross-section having the shape of a semi-ellipse and becomes continuously wider downward. The ventilation hole 368*a*, the sub-space 377, and the ventilation channel 370 form an atmosphere communication portion 376. The sub-space 377 has a vertical guide surface 377*a* which is opposed to the entrance 370*a* of the ventilation channel 370 and functions as an ink guide portion. The guide surface 377*a* is located directly below the ventilation hole 368*a*.

Ink which has flowed into the sub-space 377 is guided along the guide surface 377*a* to an opposite region of the sub-space 377 from the entrance 370*a*. Therefore, it is more difficult for ink which has flowed into the sub-space 377 to flow into the entrance 370*a*, and therefore, the ventilation channel 370 can be less likely to be clogged with ink.

Figure 11:
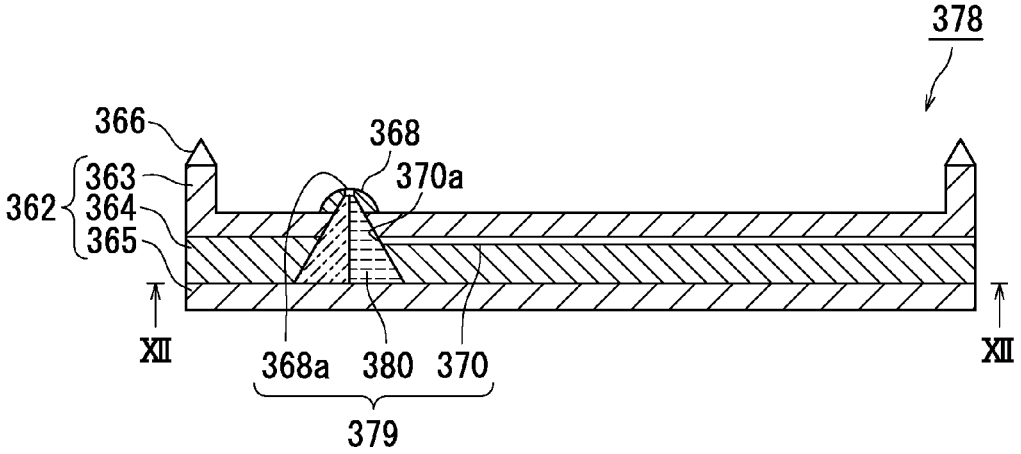
FIG. 11 is a cross-sectional view of a cap according to a fourth embodiment.
Figure 12:
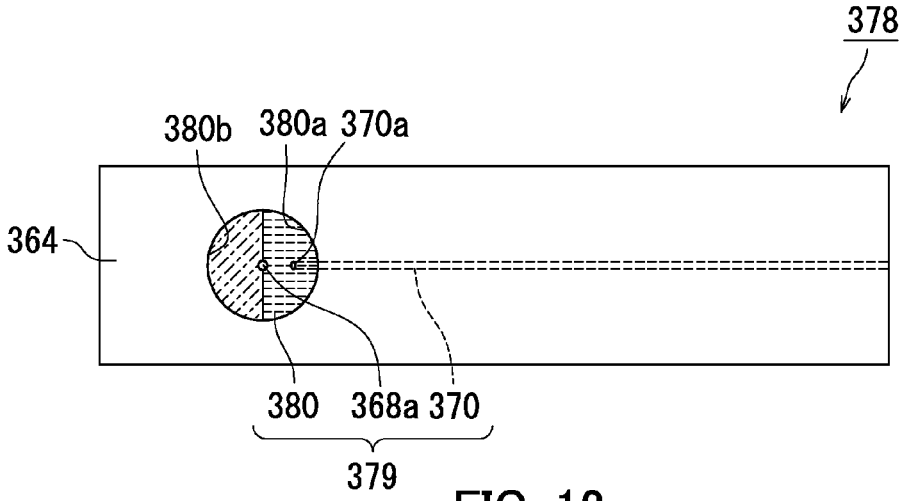
FIG. 12 is a cross-sectional view taken along line XII-XII of FIG. 11.

Next, a fourth embodiment of the present disclosure will be described. FIG. 11 is a cross-sectional view of a cap 378 of the fourth embodiment. FIG. 12 is a cross-sectional view taken along line XII-XII of FIG. 11. Note that, in the fourth embodiment, parts corresponding to those of the first embodiment are indicated by the same reference characters and will not be redundantly described.

The cap 378 of this embodiment includes a sub-space 380 having the shape of a circular cone. The ventilation hole 368*a*, the sub-space 380, and the ventilation channel 370 form an atmosphere communication portion 379. An inner wall surface of the sub-space 380 is divided into two regions along an imaginary surface perpendicular to the axial line of the ventilation channel 370. Of the two regions, one which is located around the entrance 370*a* of the ventilation channel 370, is imparted water repellency and functions as a water repellent portion (ink guide portion) 380*a*. The other region which is opposed to the entrance 370*a*, is imparted hydrophilicity and functions as a hydrophilic portion (ink guide portion) 380*b*.

In FIGS. 11 and 12, a water repellent region of the water repellent portion 380*a* is indicated by hatching with broken lines. A treatment for imparting water repellency is, for example, application of fluorine paint or application of silicone resin.

In FIGS. 11 and 12, a hydrophilic region of the hydrophilic portion 380*b* is indicated by hatching with dash-dot lines. A treatment for imparting hydrophilicity is, for example, coating of glass fiber or application of resin paint. Alternatively, a surface of a material for the sub-space 380 may be delustered.

It is difficult for ink which has flowed into the sub-space 380 to flow along the water repellent portion 380*a*, and the ink is more likely to flow along the hydrophilic portion 380*b*. Therefore, ink is less likely to flow into the entrance 370*a*, and therefore, the ventilation channel 370 can be less likely to be clogged with ink.

In the foregoing, embodiments of the present disclosure have been described. The present disclosure is not intended to be limited to the above embodiments. Various changes and modifications can be made to the above embodiments.

In the fourth embodiment, the inner wall surface of the sub-space has the water repellent portion and the hydrophilic portion. Alternatively, for example, the inner wall surface of the sub-space may have only one of the water repellent portion and the hydrophilic portion.

In the above embodiment of the present disclosure, the inkjet recording device forms an image on paper. The inkjet recording device may form an image on other recording media (e.g., a plastic sheet, cloth, etc.).

The ink guide portion of the fourth embodiment may be incorporated in the ink guide portion of the second or third embodiment. For example, the hydrophilic portion of the fourth embodiment may be provided on the acute angle portion of the second embodiment or the guide surface of the third embodiment. Also, the water repellent portion of the fourth embodiment may be provided around the entrance of the ventilation channel of the second or third embodiment.

In the above embodiments, the present disclosure is applied to an inkjet recording device including a line type recording head fixed to the device housing. The present disclosure is not limited to such an inkjet recording device. For example, the present disclosure may be applied to an inkjet recording device including a recording head which is movable relative to the device housing. For example, the present disclosure may be applied to an inkjet recording device including a serial type recording head.

Various other changes and modifications can be made to the above embodiments without departing the spirit and scope of the present disclosure.

What is claimed is:

1. A cap for capping an ink outlet of a nozzle head, comprising:

a cap body configured to come into contact with and be pressed against a portion around the ink outlet of the nozzle head to form a main space between the cap body and the nozzle head; and an atmosphere communication portion configured to allow the main space to be in communication with the atmosphere, wherein the atmosphere communication portion includes:

a ventilation hole open to the main space;

a sub-space configured to retain ink entering the ventilation hole; and a ventilation channel configured to allow the sub-space to be in communication with the atmosphere, the cap body includes a top wall, a middle wall, and a bottom wall, the top wall includes a pressure contact portion configured to come into contact with and be pressed against a portion around the ink outlet of the recording head, the sub-space penetrates through the middle wall and the top wall, and an upper end portion of the sub-space is in communication with the ventilation hole, and a bottom surface of the sub-space is sealed by the bottom wall.

2. A cap according to claim 1, further comprising:

an ink guide portion configured to guide the ink to an opposite region of an inner wall surface of the sub-space from an entrance of the ventilation channel, the entrance being an opening formed in the inner wall surface.

3. A cap according to claim 2, wherein the ink guide portion is configured to guide the ink by the capillary action.

4. A cap according to claim 2, wherein the ink guide portion includes a guide surface configured to guide the ink to a bottom portion of the sub-space, the guide surface being opposed to the entrance.

5. A cap according to claim 2, wherein the ink guide portion includes a water repellent portion formed on a region around the entrance of the inner wall surface of the sub-space.

6. A cap according to claim 2, wherein the ink guide portion includes a hydrophilic portion formed on a region opposed to the entrance of the inner wall surface of the sub-space.

7. A cap according to claim 1, wherein the ventilation hole is located above a bottom surface of the main space.

8. An inkjet recording device comprising:

a nozzle head having an ink outlet; and a cap configured to cap the ink outlet, wherein the cap includes:

a cap body configured to come into contact with and be pressed against a portion around the ink outlet of the nozzle head to form a main space between the cap body and the nozzle head; and an atmosphere communication portion configured to allow the main space to be in communication with the atmosphere, and the atmosphere communication portion includes:

a ventilation hole open to the main space;

a sub-space configured to retain ink entering the ventilation hole; and a ventilation channel configured to allow the sub-space to be in communication with the atmosphere, the cap body includes a top wall, a middle wall, and a bottom wall, the top wall includes a pressure contact portion configured to come into contact with and be pressed against a portion around the ink outlet of the recording head, the sub-space penetrates through the middle wall and the top wall, and an upper end portion of the sub-space is in communication with the ventilation hole, and a bottom surface of the sub-space is sealed by the bottom wall.

9. A cap for capping an ink outlet of a nozzle head, comprising:

a cap body configured to come into contact with and be pressed against a portion around the ink outlet of the nozzle head to form a main space between the cap body and the nozzle head;

an atmosphere communication portion configured to allow the main space to be in communication with the atmosphere; and an ink guide portion, wherein the atmosphere communication portion includes:

a ventilation hole open to the main space;

a sub-space configured to retain ink entering the ventilation hole; and a ventilation channel configured to allow the sub-space to be in communication with the atmosphere, the ink guide portion is configured to guide the ink to an opposite region of an inner wall surface of the sub-space from an entrance of the ventilation channel, the entrance being an opening formed in the inner wall surface, and the ink guide portion includes a water repellent portion formed on a region around the entrance of the inner wall surface of the sub-space.

10. A cap according to claim 9, wherein the ink guide portion is configured to guide the ink by the capillary action.

11. A cap according to claim 9, wherein the ink guide portion includes a guide surface configured to guide the ink to a bottom portion of the sub-space, the guide surface being opposed to the entrance.

12. A cap according to claim 9, wherein the ink guide portion includes a hydrophilic portion formed on a region opposed to the entrance of the inner wall surface of the sub-space.

13. A cap according to claim 9, wherein the ventilation hole is located above a bottom surface of the main space.

* * * * *